US010125798B2

(12) United States Patent
Vigholm et al.

(10) Patent No.: US 10,125,798 B2
(45) Date of Patent: Nov. 13, 2018

(54) METHOD FOR CONTROLLING LOWERING OF AN IMPLEMENT OF A WORKING MACHINE

(75) Inventors: Bo Vigholm, Stora Sundby (SE); Andreas Ekvall, Hallstahammar (SE); Kim Heybroek, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 1076 days.

(21) Appl. No.: 14/367,920

(22) PCT Filed: Dec. 22, 2011

(86) PCT No.: PCT/SE2011/000242
§ 371 (c)(1),
(2), (4) Date: Jul. 15, 2014

(87) PCT Pub. No.: WO2013/095208
PCT Pub. Date: Jun. 27, 2013

(65) Prior Publication Data

US 2014/0366951 A1 Dec. 18, 2014

(51) Int. Cl.
*F15B 21/02* (2006.01)
*E02F 9/22* (2006.01)
(Continued)

(52) U.S. Cl.
CPC ..... *F15B 21/02* (2013.01); *E02F 3/432* (2013.01); *E02F 9/2095* (2013.01);
(Continued)

(58) Field of Classification Search
CPC ..... E02F 9/22; E02F 9/2217; E02F 9/2285; F15B 11/024; F15B 21/14; F15B 21/02
(Continued)

(56) References Cited

U.S. PATENT DOCUMENTS 8,336,305 B2 * 12/2012 Matsuura ..... E02F 9/2207 60/419
9,074,347 B2 * 7/2015 Vigholm ..... E02F 9/2217
(Continued)

FOREIGN PATENT DOCUMENTS

JP 2007170485 A 7/2007
JP 2008095788 A 4/2008
(Continued)

OTHER PUBLICATIONS

International Search Report (dated Sep. 3, 2012) for corresponding International App. PCT/SE2011/000242.
(Continued)

*Primary Examiner* — Thomas E Lazo
*Assistant Examiner* — Richard Drake
(74) *Attorney, Agent, or Firm* — WRB-IP LLP

(57) ABSTRACT

A method for controlling lowering of an implement of a working machine is provided. The working machine has a hydraulic system including a hydraulic cylinder for moving the implement and a first control valve for controlling the flow of hydraulic fluid from the piston side of the hydraulic cylinder, and a recovery unit connected to the control valve for recovering energy by receiving a return flow from the piston side of the hydraulic cylinder. The piston side of the hydraulic cylinder and the control valve are connected to each other, and the piston rod side of the hydraulic cylinder is connected to the control valve and to the recovery unit in a point between the control valve and the recovery unit. The method includes identifying a requested lowering speed of the implement, and identifying a desired pressure at the piston side of the hydraulic cylinder and controlling the recovery unit to provide a counter pressure resulting in the desired pressure at the piston side of the hydraulic cylinder, and enabling fluid communication between the piston side of
(Continued)

the hydraulic cylinder and the recovery unit, and between the piston side of the hydraulic cylinder and the piston rod side of the hydraulic cylinder, via the control valve, and controlling the control valve in such a way that the flow through the control valve corresponds to the requested lowering speed of the implement.

11 Claims, 4 Drawing Sheets

(51) Int. Cl.
*F15B 15/10* (2006.01)
*E02F 3/43* (2006.01)
*F15B 21/14* (2006.01)
*E02F 9/20* (2006.01)

(52) U.S. Cl.
CPC ..... *E02F 9/2203* (2013.01); *E02F 9/2217* (2013.01); *E02F 9/2296* (2013.01); *F15B 15/10* (2013.01); *F15B 21/14* (2013.01); *F15B 2211/20553* (2013.01); *F15B 2211/3057* (2013.01); *F15B 2211/3058* (2013.01); *F15B 2211/611* (2013.01); *F15B 2211/6306* (2013.01); *F15B 2211/6313* (2013.01); *F15B 2211/6654* (2013.01); *F15B 2211/7053* (2013.01); *F15B 2211/7058* (2013.01); *F15B 2211/88* (2013.01); *Y10T 137/0396* (2015.04)

(58) Field of Classification Search
USPC ..... 60/419, 445
See application file for complete search history.

(56) References Cited

U.S. PATENT DOCUMENTS

| | | | | |
|---|---|---|---|---|
| 2003/0221339 | A1 | 12/2003 | Naruse et al. | |
| 2006/0090462 | A1 | 5/2006 | Yoshino | |
| 2009/0000290 | A1 | 1/2009 | Brinkman et al. | |
| 2010/0089049 | A1* | 4/2010 | Matsuura | E02F 9/2207 60/419 |
| 2011/0270498 | A1* | 11/2011 | Kawasaki | E02F 9/2075 701/50 |
| 2015/0152900 | A1* | 6/2015 | Egawa | E02F 9/2285 60/419 |
| 2016/0146232 | A1* | 5/2016 | Ooki | E02F 9/123 60/420 |

FOREIGN PATENT DOCUMENTS

| | | | |
|---|---|---|---|
| JP | 2000275770 | A | 11/2009 |
| WO | 2008143568 | A1 | 11/2008 |
| WO | 2010138029 | A1 | 12/2010 |
| WO | 2011105436 | A1 | 9/2011 |

OTHER PUBLICATIONS

European Search Report (dated Jul. 6, 2015) for corresponding European App. EP 11877798.

* cited by examiner

METHOD FOR CONTROLLING LOWERING OF AN IMPLEMENT OF A WORKING MACHINE

BACKGROUND AND SUMMARY

The invention relates to a method for controlling lowering of an implement of a working machine.

The invention is applicable on working machines within the fields of industrial construction machines, in particular wheel loaders and articulated haulers. Although the invention will be described with respect to a wheel loader, the invention is not restricted to this particular machine, but may also be used in other working machines having hydraulic working functions, such as dump trucks, excavators or other construction equipment.

A working machine is provided with a bucket, container or other type of implement for digging, lifting, carrying and/or transporting a load.

A wheel loader, for instance, has working functions driven by hydraulics, such as lifting and tilting of an implement arranged on a load arm unit. The load arm unit comprises a number of hydraulic cylinders for movement of the load arm and the implement attached to the load arm. A pair of hydraulic cylinders can be arranged for lifting the load arm and a further hydraulic cylinder can be arranged on the load arm for tilting the implement.

The wheel loader which usually is frame-steered has also a pair of hydraulic cylinders for turning/steering the wheel loader by pivoting a front part and a rear part of the wheel loader relative to each other.

In addition to the hydraulic cylinders, the hydraulic system of a wheel loader comprises one or more hydraulic machines (pumps) for providing hydraulic fluid to the hydraulic cylinders of the load arm unit and the steering unit.

By the use of a recovery unit in the hydraulic system, energy can be recovered by utilizing a return flow from one or more hydraulic cylinders. The recovery unit can be a hydraulic motor driven by the return flow. The hydraulic motor is then preferably connected to an electric generator. A disadvantage with prior art hydraulic systems having a recovery unit and already known methods for recovering energy in such a hydraulic system is however the fact that a relatively large recovery unit is needed to be able to handle the flow of hydraulic fluid. The flow of hydraulic fluid is proportional to the speed of the implement. For example, when the bucket of a wheel loader is lowered this operation can be associated with a relatively large flow of hydraulic fluid in comparison to other hydraulic functions in the system. This means that the recovery unit has to be "oversized" to be able to handle the return flow or the return flow (or at least a part thereof) has to be by-passed to tank without recovering any energy. In addition, the speed of the bucket has to be controlled without any unwanted instability in the system induced by the recovery function.

It is desirable to provide a method defined by way of introduction, by which method energy can be recovered during lowering of an implement when a relatively large hydraulic return flow is created at the same time as instability in the hydraulic system is counteracted.

By the provision of a method where the fluid communication between the piston side of the hydraulic cylinder and the piston rod side of the hydraulic cylinder is enabled, the hydraulic flow to the recovery unit can be reduced. Instead a "transformation" from flow to pressure takes place due to the fact that a part of the hydraulic fluid from the piston side can flow to the piston rod side of the hydraulic cylinder. In other words; the flow to the recovery unit will decrease at the same time as the pressure in the hydraulic cylinder will increase for a given external load on the hydraulic cylinder.

By the provision of a method using a hydraulic system where the piston side of the hydraulic cylinder and the control valve are connected to each other, the control valve and the recovery unit are connected to each other, and the piston rod side of the hydraulic cylinder is connected to the control valve and to the recovery unit in a point between the control valve and the recovery unit, fluid communication between the piston side of the hydraulic cylinder and the piston rod side of the hydraulic cylinder is enabled, at the same time as a desired counter pressure can be achieved by the recovery unit while having substantially same pressure at the piston rod side of the hydraulic cylinder and the inlet side of the recovery unit.

This will increase stability in the system, since in a hydraulic system it is preferred that the pressure is substantially the same in different parts of the system. Pressure zones with different pressures are to be avoided since the control components of the hydraulic system are associated with some time-delay which can bring the components out of phase and induce instability to the system.

In a preferred embodiment of an aspect of the invention, the method comprises the step of controlling a pressure at the piston rod side of the hydraulic cylinder resulting in a minimal pressure drop over the control valve required to obtain the requested lowering speed, and controlling the recovery unit to provide a counter pressure resulting in the calculated minimal pressure drop pressure at the piston rod side of the hydraulic cylinder, and preferably this is achieved by using a control valve which valve is able to give the desired flow substantially independently of the pressure drop over the valve, at least for a certain pressure drop interval. In other words; the control valve can preferably be adjustable to give the desired flow for different pressure drops over the valve, and thereby the desired speed of the implement can be achieved for different pressure drops over the control valve. The control valve is preferably some kind of pressure compensated valve.

By controlling the pressure at the piston rod side by means of the recovery unit in a way resulting in a minimal pressure drop over the control valve required to obtain the requested lowering speed, the energy losses can be minimized at the same time as the desired speed can be achieved.

The invention also relates, according to an aspect thereof, to a computer program and a computer readable medium for performing the steps of the method according to the invention.

Further advantages and advantageous features of the invention are disclosed in the following description.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
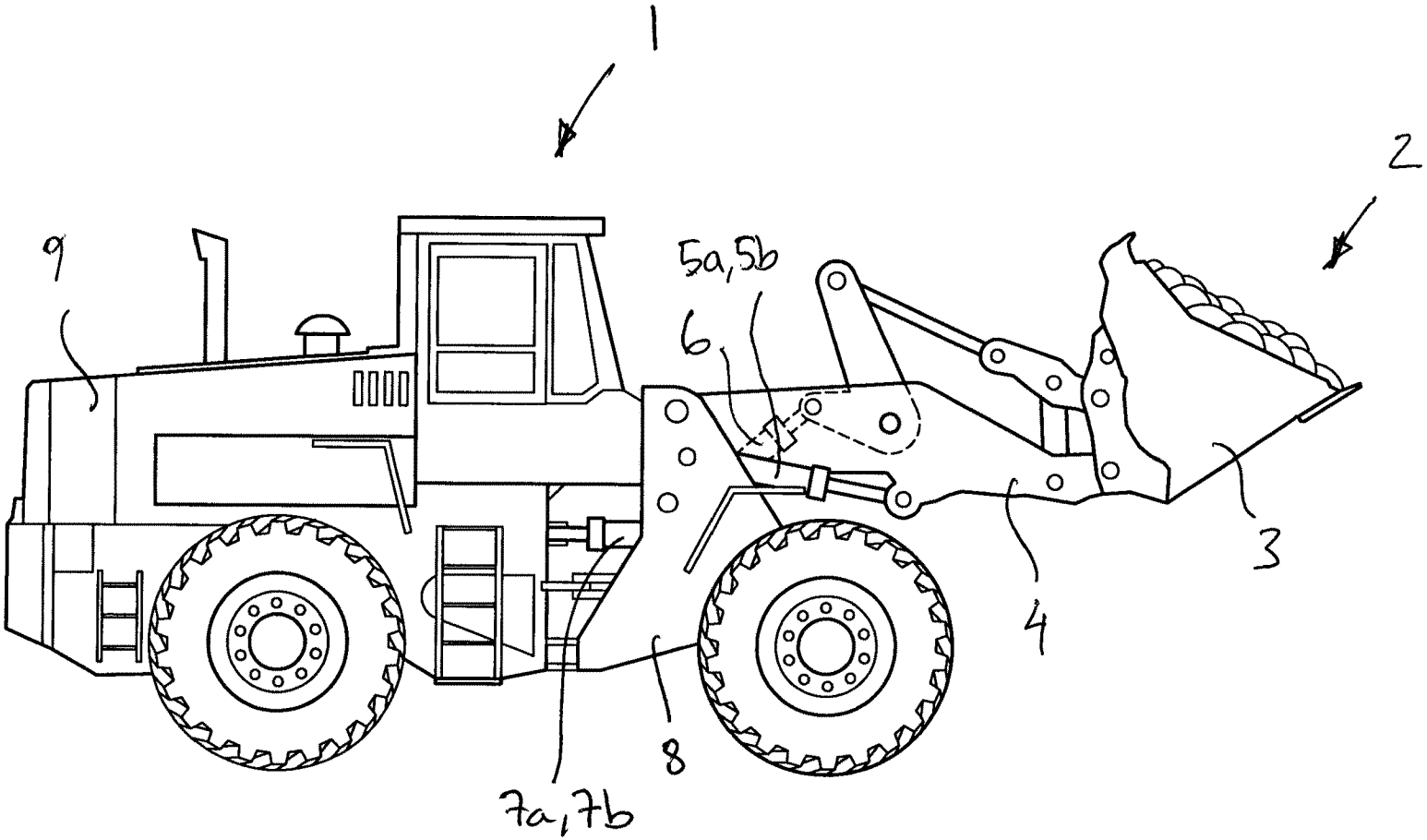
FIG. 1 is a lateral view of a wheel loader.

FIG. 1 shows a working machine 1 in the form of a wheel loader. The wheel loader 1 is to be considered as an example of a working machine having a hydraulic system to which the method according to the invention can be applied.

The wheel loader has an implement 2. The term "implement" is intended to comprise any kind of tool using hydraulics, such as a bucket, a fork or a gripping tool arranged on a wheel loader, or a container arranged on an articulated hauler. The implement illustrated is a bucket 3 which is arranged on an arm unit 4 for lifting and lowering the bucket 3, and further the bucket 3 can be tilted relative to the arm unit 4. The wheel loader 1 is provided with a hydraulic system comprising at least one hydraulic machine (not shown in FIG. 1) or hydraulic pump for providing the hydraulic system with hydraulic fluid, for example for lifting and tilting the bucket. In the example embodiment illustrated in FIG. 1 the hydraulic system comprises two hydraulic cylinders 5*a*, 5*b* for the operation of the arm unit 4 and a hydraulic cylinder 6 for tilting the bucket 3 relative to the arm unit 4. Furthermore the hydraulic system comprises two hydraulic cylinders 7*a*, 7*b* arranged on opposite sides of the wheel loader for turning the wheel loader by means of relative movement of a front body part 8 and a rear body part 9. In other words; the working machine is frame-steered by means of the steering cylinders 7*a*, 7*b*.

Figure 2:
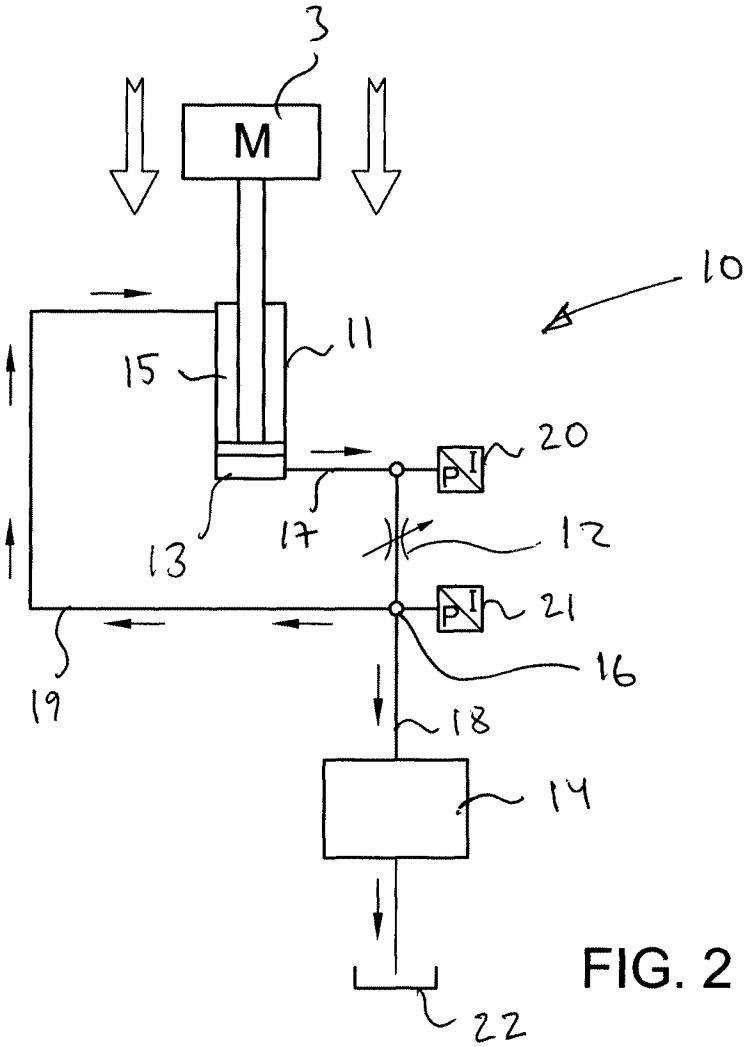
FIG. 2 is a schematic illustration of a hydraulic system for a working machine.

FIG. 2 is a schematic illustration of a hydraulic system 10. The method according to the invention can be applied together with such a hydraulic system. The hydraulic system comprises a hydraulic cylinder 11 for moving an implement 3 and a control valve 12 for controlling the flow of hydraulic fluid from the piston side 13 of the hydraulic cylinder, and a recovery unit 14 connected to the control valve 12 for recovering energy by receiving a return flow from the piston side 13 of the hydraulic cylinder 11. The piston side 13 of the hydraulic cylinder 11 and the control valve 12 are connected to each other, and the piston rod side 15 of the hydraulic cylinder 11 is connected to the control valve 12 and to the recovery unit 14 in a point 16 between the control valve 12 and the recovery unit 14. In practice a conduit 17 can connect the piston side 13 of the hydraulic cylinder with the control valve 12 and a further conduit 18 can connect the control valve 12 with an inlet side of the recovery unit 14, and a further conduit 19 can connect the piston rod side 15 of the hydraulic cylinder with the conduit 18 connecting the control valve 12 and the inlet side of the recovery unit 14. Preferably, the hydraulic system comprises one or more pressure sensors. One pressure sensor 20 can be arranged at a position between the piston side 13 of the hydraulic cylinder and the control valve 12, and one pressure sensor 21 can be arranged between the control valve 12 and the recovery unit 14. The pressure sensors are used for achieving a pressure compensated flow control. These pressure sensors could also be included within the control valve or control valve unit 12. The outlet side of the recovery unit 14 is preferably connected to a tank 22 for allowing the return flow passing the recovery unit 14 to be directed to tank 22. The counter pressure created by the recovering unit 14 multiplied with the flow through the recovery unit corresponds to the power recovered. The control valve 12 controls the flow to the recovery unit 14 in accordance with the requested lowering speed of the implement 3.

Figure 3:
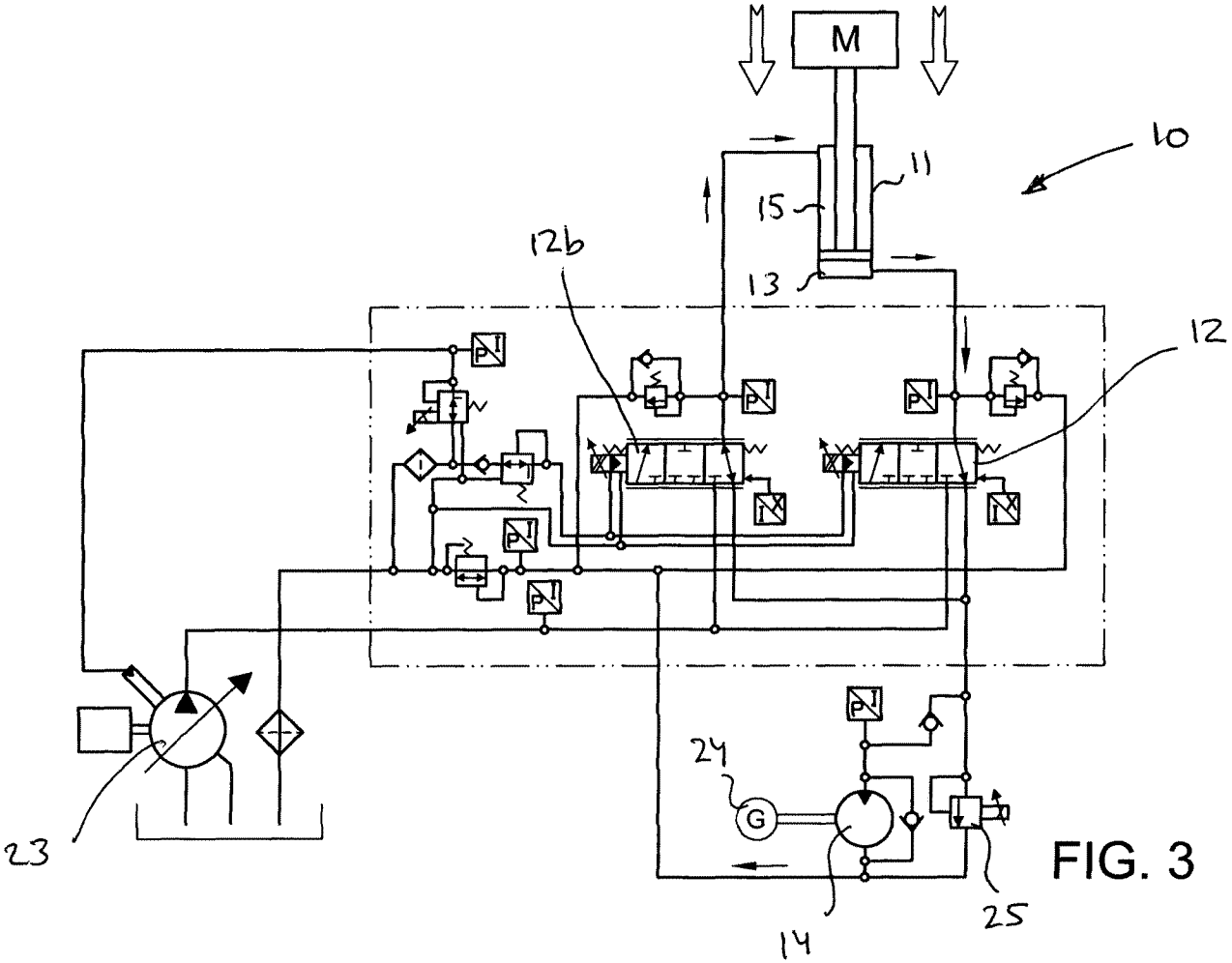
FIG. 3 is a further hydraulic system for a working machine.

FIG. 3 illustrates another example of a hydraulic system 10 which can be used for performing the method according to the invention. Hereinafter, with reference to FIG. 3, in the first place any additional components or other differences compared to the system illustrated in FIG. 2 are described. The system has a pump 23 for providing hydraulic fluid to the hydraulic cylinder 11, and a second control valve 12*b* for controlling the flow to the piston rod side 15 of the hydraulic cylinder 11. The second control valve 12*b* can be fully opened to allow free communication between the piston side 13 and the piston rod side 15 of the hydraulic cylinder 11 without any substantial pressure drop over the valve 12*b*.

The recovery unit 14 can be a hydraulic motor connected to an electric generator 24 for instance. The recovered energy may go directly to a consumer or be stored in a suitable manner. A pressure limiting valve 25 is arranged in parallel to the hydraulic motor 14 for setting a maximum allowable pressure at the return port of the first control valve 12. This pressure can be variably, for example by controlling the valve 25 by means of a control unit (not shown), and thereby an upper limit for the amount of energy desired to be recovered from the hydraulic cylinder can be selected. A return flow of hydraulic fluid from the hydraulic cylinder will flow through the recovery unit and energy will be recovered as long as the recovery unit does not produce a higher counter pressure than the set maximum allowable pressure of the valve 25. The valve can be for example a pressure limiting valve or a proportional directional valve which, by means of a control unit and pressure sensors, functions as a pressure limiting valve.

The method according to the invention, for controlling lowering of an implement of a working machine, comprises the steps of identifying a requested lowering speed of the implement, and identifying a desired pressure at the piston side of the hydraulic cylinder and controlling the recovery unit to provide a counter pressure resulting in the desired pressure at the piston side of the hydraulic cylinder. The method further comprises the steps of enabling fluid communication between the piston side of the hydraulic cylinder and the recovery unit, and between the piston side of the hydraulic cylinder and the piston rod side of the hydraulic cylinder, via the control valve, and controlling the control valve in such a way that the flow through the control valve corresponds to the requested lowering speed of the implement.

When optimizing the recovering procedure there are some limitations that may have an impact on which counter pressures can be used. Since the pressure in the hydraulic cylinder is usually not allowed to exceed above a certain maximal pressure, the counter pressure may have to be adapted thereto. Furthermore, the counter pressure may have to be adapted to achieve a sufficient pressure drop over the control valve enabling a flow of hydraulic fluid that fulfils the requested lowering speed.

There are different control principles available for the method. One way is to measure the pressure at the piston side of the hydraulic cylinder and control the recovery unit in a way resulting in the desired pressure at the piston side of the hydraulic cylinder. Another way is to control the recovery unit based on the pressure at the piston rod side of the hydraulic cylinder. The desired pressure at the piston side can still be achieved since the desired pressure at the piston rod side can be calculated from the desired pressure on the piston side, and vice versa.

In one embodiment the method comprises measuring the pressure at the piston side of the hydraulic cylinder and calculating a difference between the measured pressure and the maximal allowed pressure at the piston side of the hydraulic cylinder, and using the calculated difference as input for controlling the recovery unit to provide a counter pressure resulting in the desired pressure at the piston side of the hydraulic cylinder. This is used in a so called error-based feedback control.

In another embodiment the method comprises calculating a desired pressure at the piston rod side of the hydraulic cylinder and controlling the recovery unit to provide a counter pressure resulting in the desired pressure at the piston rod side of the hydraulic cylinder, and thereby in the desired pressure at the piston side of the hydraulic cylinder. This is used in a so called feed forward link control.

An error-based feedback control and/or a feed forward link control can be used for controlling the hydraulic system and perform the method according to the invention.

When calculating a desired pressure at the piston rod side of the hydraulic cylinder, the method can comprise calculating a pressure at the piston rod side of the hydraulic cylinder resulting in a desired or minimal pressure drop over the control valve required to obtain the requested lowering speed, and controlling the recovery unit to provide a counter pressure resulting in the calculated minimal pressure drop pressure at the piston rod side of the hydraulic cylinder. Furthermore, the method can comprise calculating a maximal allowed pressure at the piston rod side of the hydraulic cylinder based on a maximal allowed pressure at the piston side of the hydraulic cylinder, and controlling the recovery unit to provide a counter pressure resulting in a pressure at the piston rod side of the hydraulic cylinder which pressure is lower than or equal to the calculated maximal allowed pressure at the piston rod side of the hydraulic cylinder in order to keep the pressure on the piston side of the hydraulic cylinder lower than or equal to the maximal allowed pressure at the piston side of the hydraulic cylinder.

To achieve a method recovering as much energy as possible without exceeding a maximal allowed pressure, the method preferably comprises the step of calculating a pressure at the piston rod side of the hydraulic cylinder resulting in a minimal pressure drop over the control valve required to obtain the requested lowering speed and calculating a maximal allowed pressure at the piston rod side of the hydraulic cylinder based on a maximal allowed pressure at the piston side of the hydraulic cylinder, and controlling the recovery unit to provide a counter pressure resulting in a pressure at the piston rod side of the hydraulic cylinder which pressure is the lowest pressure of the calculated maximal allowed pressure and the calculated minimal pressure drop pressure, thereby ensuring the pressure on the piston side of the hydraulic cylinder to be lower than or equal to the maximal allowed pressure at the piston side of the hydraulic cylinder.

The force, including the load (denoted M in FIGS. 2 and 3) and any contribution from friction and acceleration, acting on the hydraulic cylinder 11 is preferably determined. The determined force can be used for calculating the maximal allowed pressure at the piston side 13 of the hydraulic cylinder 11. The maximal allowed pressure at the piston rod side can then be calculated. This value can be used in a so called feed forward link control of the hydraulic system. The pressure at the piston side 13 of the hydraulic cylinder 1 can be used for determining the force acting on the hydraulic cylinder 11.

Figure 4:
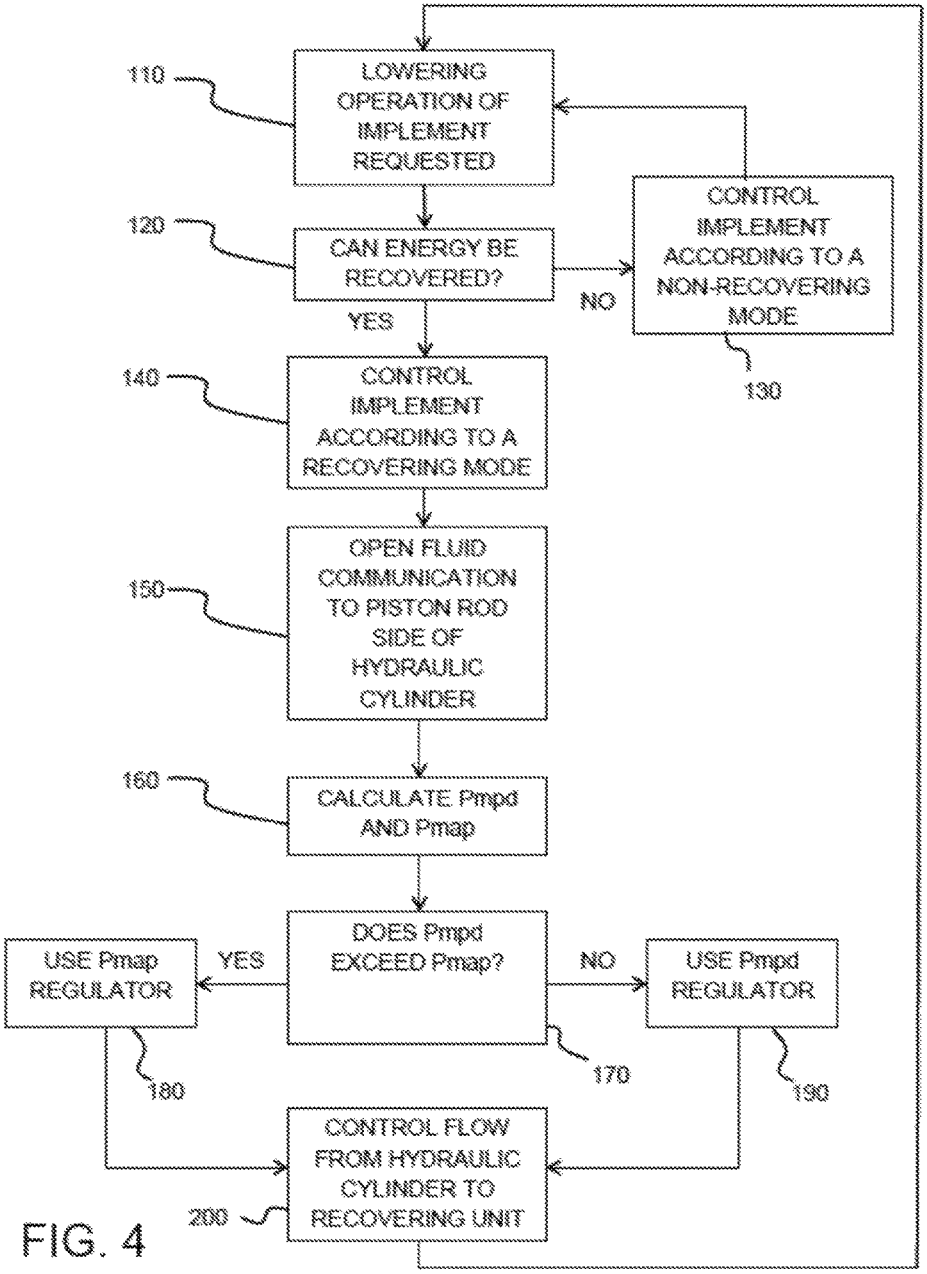
FIG. 4 is a schematic flowchart of one embodiment of the method according to the invention.

In the embodiment of the method schematically illustrated by the flowchart in FIG. 4, a lowering speed request from an operator is received by a control unit. "A lowering operation of the implement is requested" 110. Then, it is decided whether or not it is possible to recover any energy during the lowering operation. "Can energy be recovered?" 120. In a case where the load on the hydraulic cylinder is not sufficient to achieve the requested lowering speed, the pressure at the piston rod side of the hydraulic cylinder has to be increased, for example by the pump in FIG. 3, and, thus no energy is recovered. "Control the implement according to a non-recovering mode" 130. In the opposite case where the load is sufficient, energy can be recovered. "Control the implement according to a recovering mode" 140. Fluid communication between the piston side of the hydraulic cylinder and the recovery unit, and between the piston side of the hydraulic cylinder and the piston rod side of the hydraulic cylinder are performed by means of the control valve arranged between the piston side of the hydraulic cylinder and the recovering unit. With reference to FIG. 3, however, also the second control valve **12*b* has to be controlled. The second control valve 12*b* is fully opened to enable fluid communication to the piston rod side of the hydraulic cylinder. "Open the fluid communication to the piston rod side of the hydraulic cylinder" 150. Thereafter, a pressure (Pmpd) at the piston rod side of the hydraulic cylinder giving a minimal pressure drop over the control valve is calculated, and a pressure (Pmap) at the piston rod side of the hydraulic cylinder giving the maximal allowed pressure at the piston side of the hydraulic cylinder is calculated. "Calculate Pmpd and Pmap" 160. These two pressures Pmpd and Pmap are compared to find out which pressure is highest. "Does the pressure Pmpd exceed the pressure Pmap?" 170. If yes, the control unit sends signals to the recovery unit to create a counter pressure giving the maximal allowed pressure Pmap at the piston side of the hydraulic cylinder. "Use Pmap regulator" 180. If not, the control unit sends signals to the recovery unit to create a counter pressure giving a pressure Pmpd at the piston rod side of the hydraulic cylinder resulting in a minimal pressure drop over the control valve. "Use Pmpd regulator" 190. Then the control valve is controlled to achieve a flow of hydraulic fluid corresponding to the requested lowering speed. "Controlling the flow from the hydraulic cylinder to the recovering unit" 200**. Some or all method steps mentioned above are preferably continuously repeated.

It is to be understood that the present invention is not limited to the embodiments described above and illustrated in the drawings; rather, the skilled person will recognize that many changes and modifications may be made within the scope of the appended claims.

The invention claimed is:

1. A method for controlling lowering of an implement of a working machine, the working machine having a hydraulic system comprising a hydraulic cylinder for moving the implement and a first control valve for controlling the flow of hydraulic fluid from a piston side of the hydraulic cylinder, and a recovery unit connected to the control valve for recovering energy by receiving a return flow from the piston side of the hydraulic cylinder, the piston side of the hydraulic cylinder and the control valve being connected to each other, and a piston rod side of the hydraulic cylinder being connected to the control valve and to the recovery unit at a point between the control valve and the recovery unit, the method comprising:

identifying a requested lowering speed of the implement, identifying a desired pressure at the piston side of the hydraulic cylinder based on the requested lowering speed and controlling a counter pressure provided by the recovery unit to provide a counter pressure at the piston rod side resulting in the desired pressure at the piston side of the hydraulic cylinder, enabling fluid communication between the piston side of the hydraulic cylinder and the recovery unit, and between the piston side of the hydraulic cylinder and the piston rod side of the hydraulic cylinder, via the control valve, and controlling the control valve in such a way that the flow through the control valve corresponds to the requested lowering speed of the implement.

2. A method according to claim 1, comprising calculating a desired pressure at the piston rod side of the hydraulic cylinder and controlling the recovery unit to provide a counter pressure resulting in the desired pressure at the piston rod side of the hydraulic cylinder, and thereby in the desired pressure at the piston side of the hydraulic cylinder.

3. A method according to claim 2, comprising calculating a pressure at the piston rod side of the hydraulic cylinder resulting in a desired pressure drop over the control valve, and controlling the recovery unit to provide a counter pressure resulting in the calculated desired pressure drop pressure at the piston rod side of the hydraulic cylinder.

4. A method according to claim 3, comprising calculating a pressure at the piston rod side of the hydraulic cylinder resulting in a minimal pressure drop over the control valve required to obtain the requested lowering speed, and controlling the recovery unit to provide a counter pressure resulting in the calculated minimal pressure drop pressure at the piston rod side of the hydraulic cylinder.

5. A method according to claim 2, comprising calculating a maximal allowed pressure at the piston rod side of the hydraulic cylinder based on a maximal allowed pressure at the piston side of the hydraulic cylinder, and controlling the recovery unit to provide a counter pressure resulting in a pressure at the piston rod side of the hydraulic cylinder which pressure is lower than or equal to the calculated maximal allowed pressure at the piston rod side of the hydraulic cylinder in order to keep the pressure at the piston side of the hydraulic cylinder lower than or equal to the maximal allowed pressure at the piston side of the hydraulic cylinder.

6. A method according to claim 2, comprising calculating a pressure at the piston rod side of the hydraulic cylinder resulting in a minimal pressure drop over the control valve required to obtain the requested lowering speed and calculating a maximal allowed pressure at the piston rod side of the hydraulic cylinder based on a maximal allowed pressure at the piston side of the hydraulic cylinder, and controlling the recovery unit to provide a counter pressure resulting in a pressure at the piston rod side of the hydraulic cylinder which pressure is the lowest pressure of the calculated maximal allowed pressure and the calculated minimal pressure drop pressure, thereby ensuring the pressure at the piston side of the hydraulic cylinder to be to lower than or equal to the maximal allowed pressure at the piston side of the hydraulic cylinder.

7. A method according to claim 1, comprising measuring the pressure at the piston side of the hydraulic cylinder and calculating a difference between the measured pressure and a maximal allowed pressure at the piston side of the hydraulic cylinder, and using the calculated difference as input for controlling the recovery unit to provide a counter pressure resulting in the desired pressure at the piston side of the hydraulic cylinder.

8. A method for controlling lowering of an implement of a working machine, the working machine having a hydraulic system comprising a hydraulic cylinder for moving the implement and a first control valve for controlling the flow of hydraulic fluid from the piston side of the hydraulic cylinder, and a recovery unit connected to the control valve for recovering energy by receiving a return flow from the piston side of the hydraulic cylinder, the piston side of the hydraulic cylinder and the control valve being connected to each other, and the piston rod side of the hydraulic cylinder being connected to the control valve and to the recovery unit in a point between the control valve and the recovery unit, the method comprising:

identifying a requested lowering speed of the implement, identifying a desired pressure at the piston side of the hydraulic cylinder and controlling a counter pressure provided by the recovery unit to provide a counter pressure resulting in the desired pressure at the piston side of the hydraulic cylinder, enabling fluid communication between the piston side of the hydraulic cylinder and the recovery unit, and between the piston side of the hydraulic cylinder and the piston rod side of the hydraulic cylinder, via the control valve, controlling the control valve in such a way that the flow through the control valve corresponds to the requested lowering speed of the implement, and determining the force acting on the hydraulic cylinder, and using the determined force for calculating a maximal allowed pressure at the piston side of the hydraulic cylinder.

9. A method according to claim 8, comprising measuring the pressure at the piston side of the hydraulic cylinder, and using the measured pressure at the piston side of the hydraulic cylinder for determining the force acting on the hydraulic cylinder.

10. A non-transitory computer program product comprising a computer program for performing the steps of claim 1 when the program is run on a computer.

11. A non-transitory computer readable medium comprising a computer program for performing the steps of claim 1 when the program is run on a computer.

* * * * *